US006491743B1

(12) United States Patent
Joannou et al.

(10) Patent No.: US 6,491,743 B1
(45) Date of Patent: Dec. 10, 2002

(54) ELECTRONIC CARTRIDGE FILTER

(76) Inventors: Constantinos J. Joannou, 93 Hobart Crescent, Nepean Ontario (CA), K2H 5S3; David J. French, 418 Parker, Aylmer, Quebec (CA), J9H 4PS ( * ) Notice: Subject to any disclaimer, the term of this patent is extended or adjusted under 35 U.S.C. 154(b) by 0 days.

(21) Appl. No.: 09/658,998

(22) Filed: Sep. 11, 2000

(51) Int. Cl.[7] ..... B03C 3/155
(52) U.S. Cl. ..... 96/67; 55/521; 96/98
(58) Field of Search ..... 96/67, 66, 96–98, 96/69; 55/521

(56) References Cited

U.S. PATENT DOCUMENTS

| | | | | | |
|---|---|---|---|---|---|
| 2,297,601 | A | * | 9/1942 | Williams | 96/67 |
| 2,502,560 | A | * | 4/1950 | Dahlman | 96/67 |
| 2,593,869 | A | * | 4/1952 | Fruth | 96/96 X |
| 2,814,355 | A | * | 11/1957 | Powers | 96/67 |
| 2,818,134 | A | * | 12/1957 | Powers | 96/67 |
| 2,864,460 | A | * | 12/1958 | Powers | 96/67 |
| 2,868,319 | A | * | 1/1959 | Rivers | 96/67 |
| 2,888,092 | A | * | 5/1959 | Powers | 96/67 |
| 2,917,130 | A | * | 12/1959 | Powers | 96/67 |
| 3,706,182 | A | * | 12/1972 | Sargent | 96/55 |
| 4,244,710 | A | * | 1/1981 | Burger | 422/4 X |
| 4,496,375 | A | * | 1/1985 | Le Vantine | 96/66 |
| 4,509,958 | A | * | 4/1985 | Masuda et al. | 96/67 X |
| 4,549,887 | A | * | 10/1985 | Joannou | 55/493 X |
| 4,750,921 | A | * | 6/1988 | Sugita et al. | 96/67 |
| 4,781,736 | A | * | 11/1988 | Cheney et al. | 96/67 X |
| 4,955,991 | A | * | 9/1990 | Torok et al. | 96/97 X |
| 4,976,752 | A | * | 12/1990 | Torok et al. | 96/97 X |
| 5,108,470 | A | * | 4/1992 | Pick | 96/66 X |
| 5,466,279 | A | * | 11/1995 | Hattori et al. | 96/98 X |
| 5,518,531 | A | * | 5/1996 | Joannu | 96/97 X |
| 5,573,577 | A | * | 11/1996 | Joannou | 96/96 X |
| 6,077,334 | A | * | 6/2000 | Joannou | 96/66 |

FOREIGN PATENT DOCUMENTS

| | | | | |
|---|---|---|---|---|
| FI | 91604 | * | 4/1994 | |
| GB | 827157 | * | 2/1960 | 96/67 |
| GB | 827158 | * | 2/1960 | |
| GB | 2083380 | * | 3/1982 | |
| GB | 2110119 | * | 6/1983 | |
| GB | 2156245 | * | 10/1985 | |

* cited by examiner

*Primary Examiner*—Richard L. Chiesa
(74) *Attorney, Agent, or Firm*—David J. French

(57) ABSTRACT

An electrostatic precipitator type filter is combined with replaceable, polarizable trapping media. In one aspect of the invention, the media is fitted between polarizing plates. In another aspect, the media is coated in sections to form a conductive surface which serve as the equivalent to the charged plates of the precipitator. These electrodes may be alternately displaced to provide a ready means to effect electrical connections.

20 Claims, 6 Drawing Sheets

ELECTRONIC CARTRIDGE FILTER

FIELD OF THE INVENTION

This invention relates to air filters. In particular, it relates to electronically-enhanced filters that include a trapping medium.

BACKGROUND TO THE INVENTION

Precipitator-type air filters of the type depicted in U.S. Pat. No. 2,593,869 to Fruth (1952) operate by first ionizing particulate-carrying air to charge dust contained therein, and then pass the air between oppositely charged, end-on aligned parallel plates to which the dust adheres. Such precipitating air cleaners are highly efficient when the plates are initially clean. However, performance drops off as the plates become covered with collected dust. Hence, regular cleaning is required to maintain efficiency. This cleaning operation for precipitator-type air cleaners is awkward and costly to effect.

An advantage of filters of the trapping media type is that such media may be readily removed and replaced once they are filled with dust.

It is known that in trapping airborne particles in disposable filter media such as fibrous matrices of glass, wool and the like, the trapping capacity of such filter media can be enhanced by ionizing the air, and charging the dust therein, before it enters the filter medium. U.S. Pat. Nos. 3,706,182 to Sargent (1972), and 4,244,710 to Burger (1981) both depict such an arrangement. In both of these references, ions are introduced into the airflow stream by ion emitters positioned at an upstream location in the airflow, at a spaced distance from the filter medium that is intended to trap and remove charged particles from the airflow. Prior inventions by the present inventor also rely on the upstream release of ions into an air flow as presented in U.S. Pat. Nos. 5,518,531 (1996) and 6,077,334 (Jun. 20 2000).

It is also known that the trapping of dust particles, especially charged dust particles, can be enhanced by using as a trapping medium an air-permeable matrix of non-conducting, polarizable material. Local dipoles formed within such medium help trap and bind dust particles. An example of a prior art reference based on this principle is U.S. Pat. No. 4,549,887, by the present inventor.

The present invention makes use of the airflow-aligned, charged parallel plate principle and, optionally, the ionization principle in conjunction with polarized media to provide an improved performance air filter.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

In one aspect of the invention a series of generally parallel, alternately charged metal electrodes, aligned to receive air-flow are edge-on, used as polarizing electrodes to polarize trapping media contained between electrodes. The trapping medium may be in the form of a fibrous dielectric pad and/or may comprise pleated panels of air permeable trapping material. The electrodes are preferably aligned parallel to the airflow (although this is optional, to provide a polarizing, transverse field though the trapping medium. The polarizing electrodes may be in the form of plates between which the trapping media is placed. Alternately, polarizing electrodes may be formed right on the trapping media surface as by sheets of conductive screening or fabric. This can also be effected by rendering surface segments of the trapping media conducting as well as by providing air permeable conductive layer laid over such surfaces. The electrodes and trapping media may conveniently be formatted as a cartridge for ready removal and replacement.

In all of these variants, ionization may be provided upstream in the arriving airflow by a series of ionizing needles or other ionizing elements such as fine wires or conducting strings (c.f. U.S. Pat. No. 5,573,577, Nov. 12, 1996 by the present inventor). Such ionization charges dust particles in the air flow, enhancing further the trapping efficiency of the media present in the polarizing field formed between the oppositely charged polarizing electrodes.

Conductive surface portions may be formed on alternating sections of trapping medium constructed as a continuous surface folded into pleated panels by coating the medium with a conductive material, such as fine carbon or aluminum, preferably mixed with a binder. Conductive surfaces may also be formed by transferring conductive panels of conductive, porous (air-permeable) media to the trapping media as by an adhesive.

With trapping media contained between polarizing electrodes, a high potential voltage source is connected to provide a polarizing potential difference between consecutive electrodes. This potential difference not only tends to polarize the intervening portions of the trapping medium but also creates an electrical potential field between the electrodes with a high field gradient. Dust particles, particularly charged dust particles, are drawn laterally in the air flow by this transverse field to contact and be retrained in the trapping medium.

By these arrangements an improved air filter of increased efficiency and cost effectiveness is provided.

The foregoing summarizes the principal features of the invention and some of its optional aspects. The invention may be further understood by the description of the preferred embodiments, in conjunction with the drawings, which now follow.

BRIEF DESCRIPTION OF THE DRAWINGS

FIG. 5A is a pictorial depiction of the pleated media of FIG. 5 in transition as it is being folded to provide the compacted fitter assembly of FIG. 5;

DESCRIPTION OF THE PREFERRED EMBODIMENT

Figure 1:
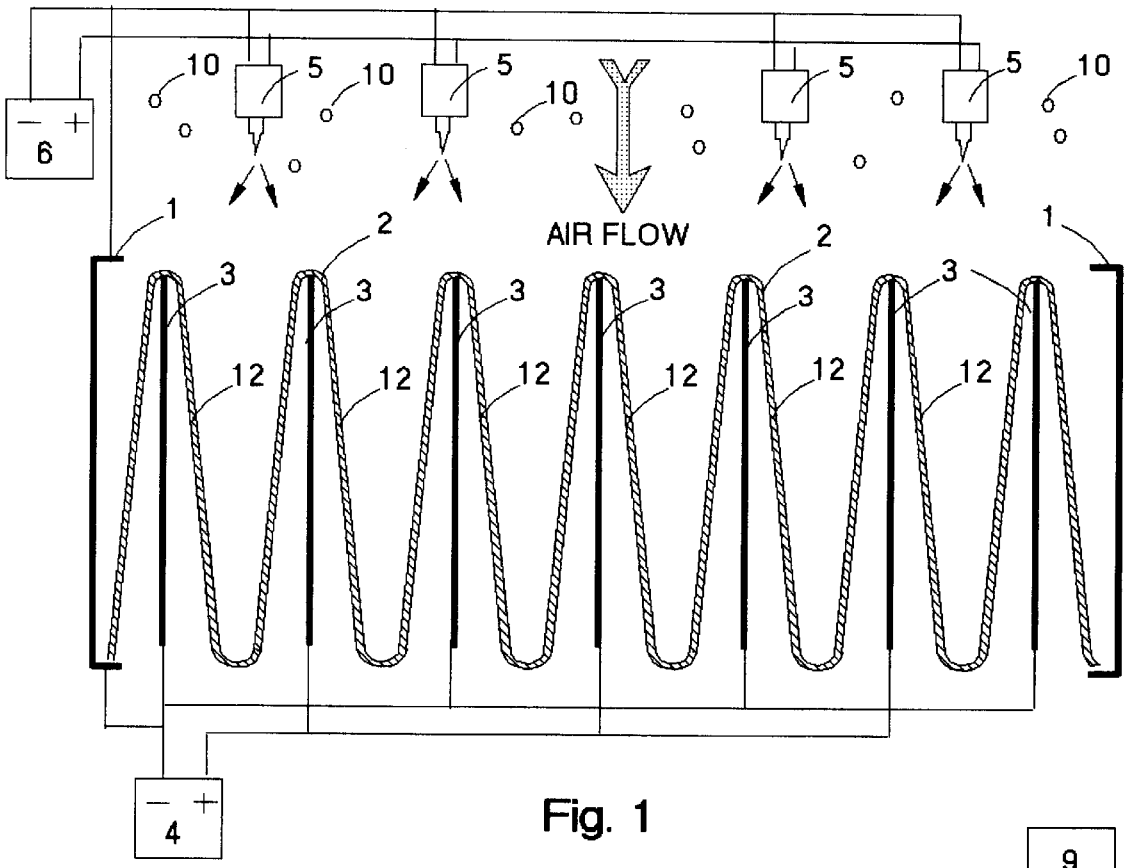
FIG. 1 shows a cross-sectional plan view of the air cleaner of the invention wherein polarizable, pleated filter media is disposed around charged polarizing plates.

In FIG. 1 a casing 1 or frame 1 contains the elements of the air cleaner. A permeable filter medium 2 of paper or the like which may be pleated is removably placed between and around a series of consecutive conductive plates 3 which serve as electrodes. While numerous plates are shown, the invention will work with two plates. It is highly preferable, however, to employ many plates.

Consecutive conductive plates 3 are respectively insulated from each other and are alternately connected to a high voltage power supply 4 which provides polarizing voltage of differential polarity between adjacent plates 3. Permissibly, one set of plates 3 may be grounded. The object is to provide a strong electrostatic field with a steep gradient between the plates 3 and across the panels 12 of medium 2.

A set of ionizing elements 5 charge the dust particles 10 arriving in front of the filter to increase its collecting efficiency. Ionizing elements 5 are supplied with high voltage from power supply 6.

As an alternative to a single pleated sheet, a polarizable fiber matrix or the like may be inserted between the plates 3 as shown subsequently in FIG. 7, below.

Figure 2:
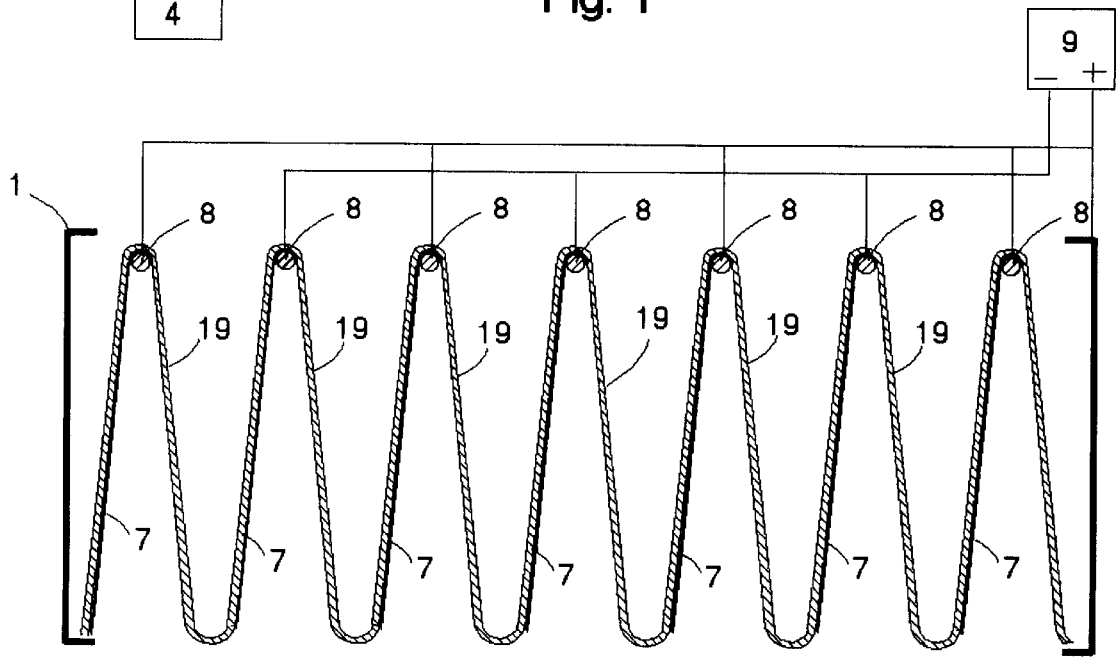
FIG. 2 shows a cross-sectional plan view of an alternate format air cleaner wherein the pleated filter trapping medium is coated with conductive paint in strips and the strips are charged with high voltage of alternating polarity to form the polarizing electrodes.
Figure 3:
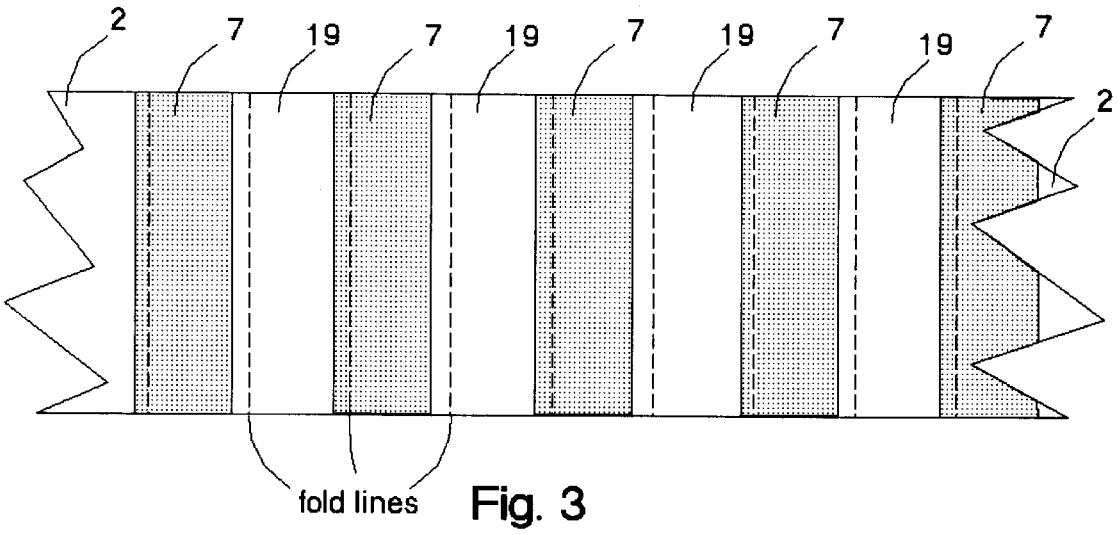
FIG. 3 is a plan view of the stretched-out pleated media of FIG. 2 to demonstrate how the media is coated with conductive paint in strips.

FIG. 2 shows an alternate way of providing an electrostatic field across medium 2. A conducting coating 7 such as graphite or aluminum powder with a binder is applied to the surface of filter medium 2 in non-contiguous panel sections as shown in FIG. 3 to provide the electrodes. Conductivity may also be imparted to the panels by applying an infiltrating conductive liquid that leaves a conductive deposit e.g. colloidal carbon in a solution; or an air-permeable, conductive layer may be transferred to the sections of surfaces of the trapping medium 2 and held in place by an adhesive. Examples of such a layer include conducive fabrics such as copper-treated polypropylene fabric, conductive plastic grids and wire mesh screens of aluminum or the like. Schedule A shows the amendments being made to this paragraph.

While every other panel 19 is shown as having a conductive surface 7 in FIG. 2, coating may also be effected intermittently so as to leave more than one intermediate panel 19 uncoated.

Metal rods 8 held by the frame 1 support medium 2 and at the same time make contact with the coated sections 7 on medium 2. Adjacent metal rods 8 are insulated from each other and they are respectively connected to the high voltage power supply 9 so as to be alternately charged with differing potentials. The conductive coatings 7, because they come in contact with metal rods 8, become charged with differing electrical potentials and thus produce a strong electrostatic field between them.

Figure 4:
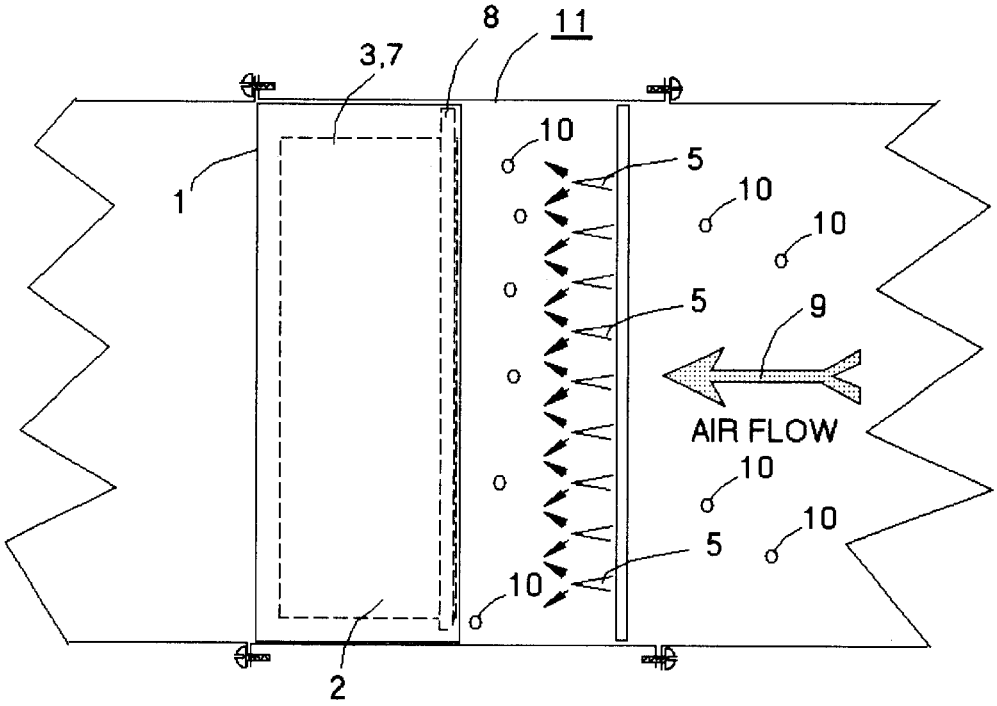
FIG. 4 is a cross-sectional side view of the air cleaner assembly of FIG. 1 mounted in an air duct with ionizing elements placed in front of the air filter.

FIG. 4 shows the air cleaner with its frame 1 installed into in a duct 11 of an air handling system. Ionizing elements 5 are optionally located upstream in the airflow 9. The frame 1 is readily removeable to permit servicing, and replacement of the filter medium 2.

Figure 5:
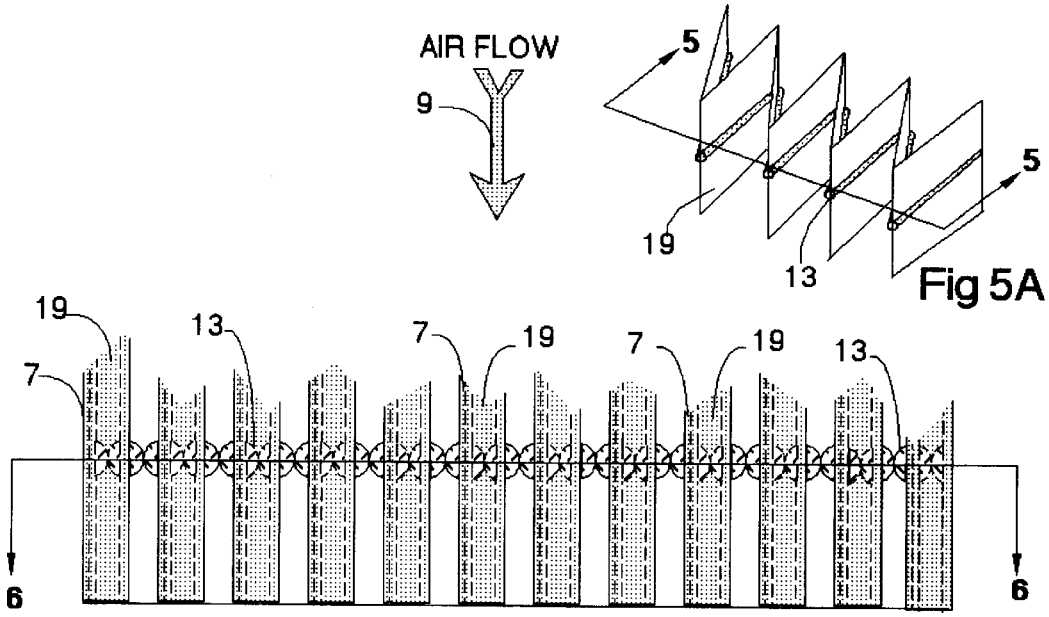
FIG. 5 is a cross-sectional rear end view of the pleated media of FIG. 2 compacted with glue-beads positioned to separate the folded pleats.
Figure 6:
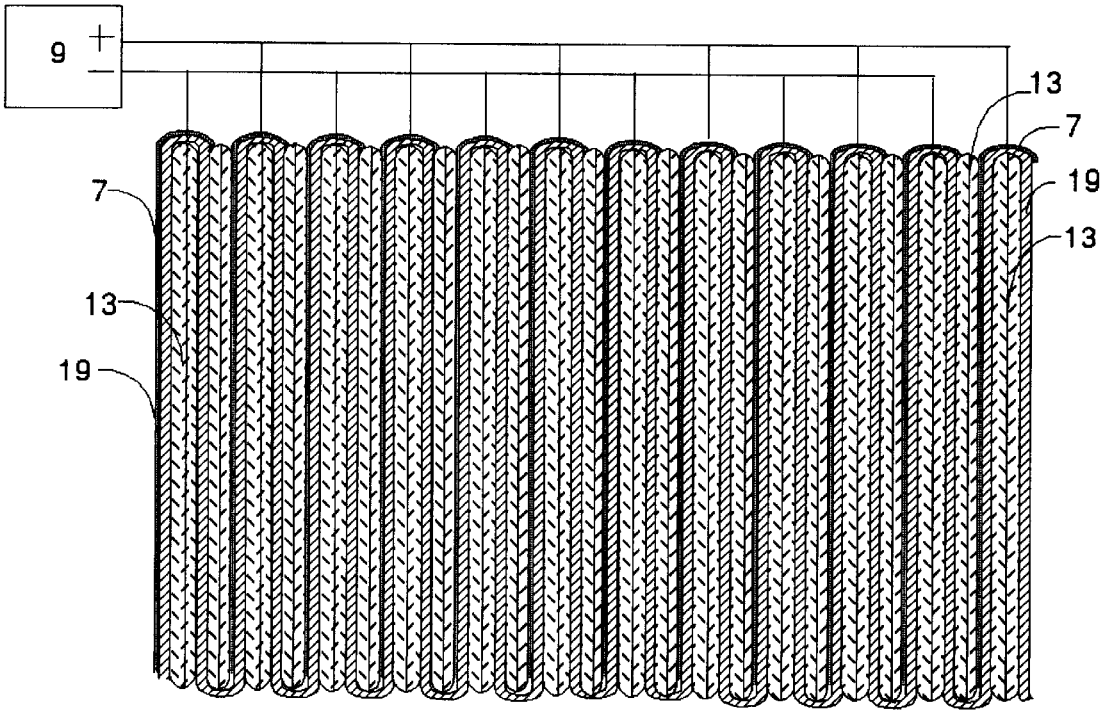
FIG. 6 is a cross-sectional plan view of the media of FIG. 5 taken through the lines of glue beading showing the connection of the polarizing voltage source to the panel electrodes.

FIGS. 5 and 6 show a pleated filter wherein the pleat panels 19 are separated by lengths of beads 13 of glue applied to the filter media 2 before it is pleated. The glue beads 13 keep the pleat panels 19 apart and at the same time make the filter self-supporting without any need for other structure, such as a screen.

The parts of the medium 2 that are coated, are charged to differential voltages as before by high voltage power supply 9. This voltage can be applied, for example, by contacting fingers respectively carried on two contactor bars to every other conductive surface 7. This type of filter can achieve efficiencies which are superior to a filter lacking the polarization feature.

Figure 7:
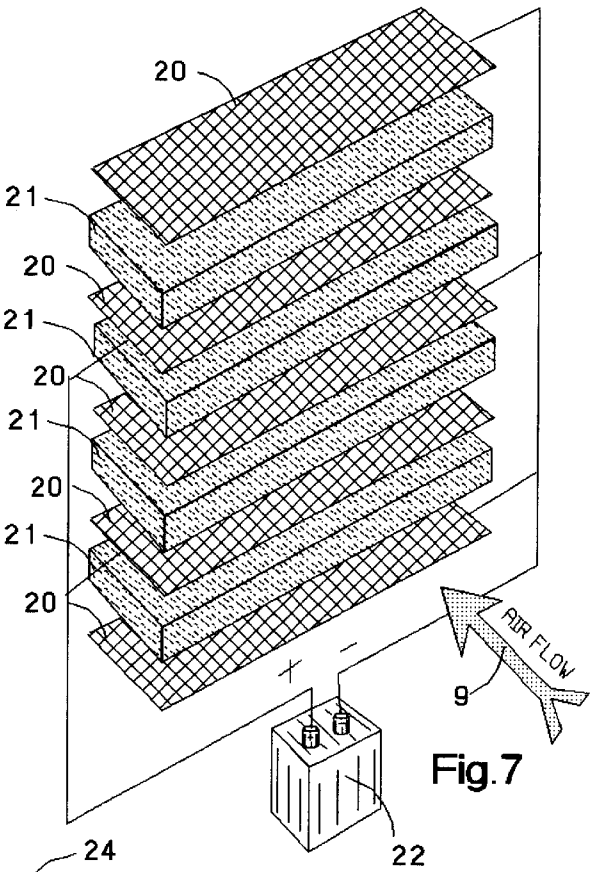
FIG. 7 depicts an alternate arrangement wherein multiple pieces of air-permeable, fibrous trapping media of dielectric material are sandwiched between conductive screens or plates.
Figure 8:
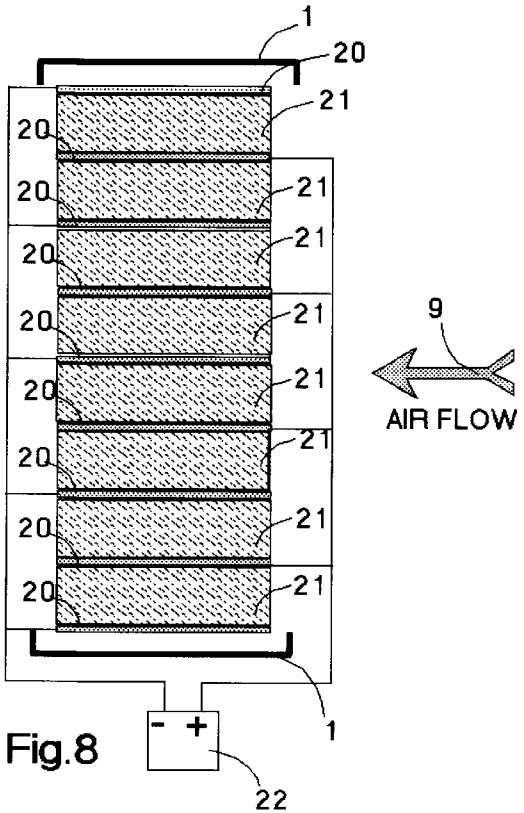
FIG. 8 shows a cross-sectional top view of the arrangement of FIG. 7.

In FIGS. 7 and 8 conductive plates 7 or screens 20 are positioned to serve as electrodes between sections of fibrous trapping media 21. Electrode screens 20 are alternately charged by high voltage power supply 22 thus providing a strong electrostatic field between such screens 20 which, in turn, polarizes sections of media 21 placed between the plates 2. The air-flow 9 enters the media 21 edge-on and flows through the body of the media 21. The extent of this flow, and trapping efficiency, can be controlled by varying the depth of the media 21.

The plates 7 or screens 20 need not be perfectly aligned, in parallel with the airflow 9. Such plates 20 may be obliquely inclined to the direction of the entering airflow. In either case, the screens 20 receive the airflow 9 edge-on, as do the media sections 21. And the airflow 9 between the screens 20 passes in a direction which is parallel to the surface of the electrode (in the colloquial sense, and not parallel to the mathematical direction of such surface).

Figure 9:
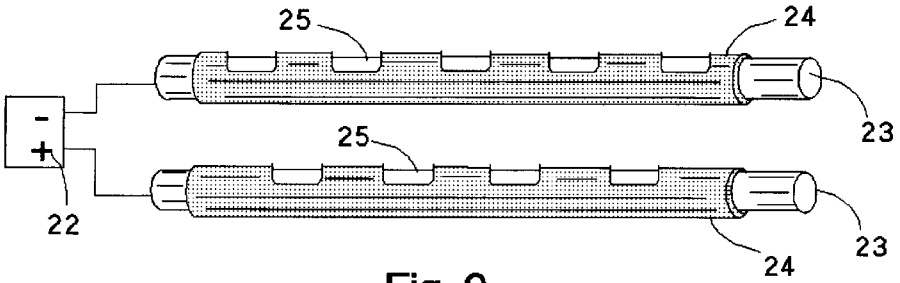
FIG. 9 shows two interrupted contacting bars for connecting the plates or screens of FIGS. 7 and 8 to a power supply.

FIG. 9 shows a method of connecting the plates or screens 20 to a high voltage power supply. Conductive rods 23 are insulated from the frame 1 of the filter and are connected to high voltage power supply 22. These rods 23 carry insulator sleeves 24 which have cut-outs 25 to expose the rods 23 at alternating intervals. Thus, when the filter of FIGS. 7 and 8 is pressed against the rods 23, one half of the screens 20 will make contact with one rod 23 and the other half with the other rod 23. In this way, the screens 20 in the filter are connected to alternate polarities of the power supply.

Operation of the air cleaner is as follows. Air flow 9 coming into the device as shown in FIG. 4 first passes by the ionizing elements 5 whereby the dust particles 10 acquire a charge. Further down the duct 11, the dust particles 10 encounter the strong, transverse polarizing electrostatic field present between the plates 3 or conducting surfaces 7 and are attracted towards such plates 3 or conducting surfaces 7 of the media 2. As the dust particles 10 move towards the plates 3, or surfaces 7, they become deposited on the media 2. To maintain the air cleaner in optimum operating condition, the media 2 is replaced with new, clean media 2 on a regular basis.

Optionally, the air cleaner may omit the ionizing elements 5 but the filter's efficiency will suffer.

In FIG. 2 the conductive surface 7 is depicted as being on the inside of the folds of the pleats 2, extending around inside of the fold to contact rods 8 that are alternately charged to polarizing potentials. Such an arrangement requires installation of the folded pleats around the rods 8.

In FIG. 6, the conductive surface 7 is depicted as being on the outside of the folds in the pleats 2. Electrical contact with alternating conductive surfaces 7 has previously been proposed to be established by two contactor bars carrying a series of contacting fingers.

Figure 3A:
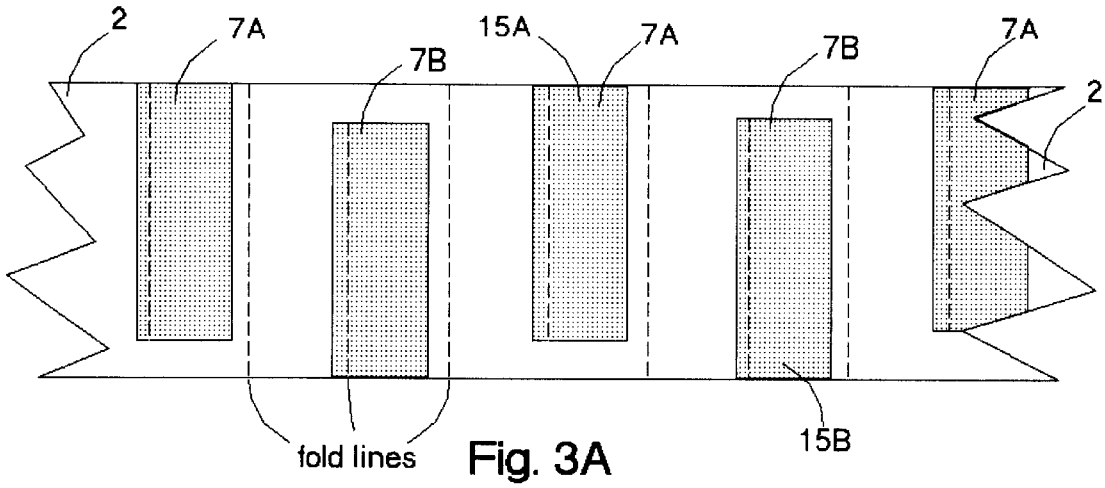
FIG. 3A is a variant on FIG. 3 that allows electrical contact to be made on the leading face of the filter media.

In FIG. 3A an alternate pattern for applying the conductive surface to the media 2 is provided. In FIG. 3A every alternate conductive surface 7A is displaced upwardly and the intervening conductive surfaces 7B are displaced downwardly. The result is that the extending portions 15A,15B of the respective conductive surfaces 7A,7B, along the upper and lower borders of the pleated media 2 are respectively aligned. This is shown in FIG. 10 wherein a pleated filter cartridge 16 of this type is shown, assembled with glue beads 13 as inter-panel spacers.

Based on the disclosed alignment for the conductive surfaces 7A,7B, electrical contact can be made with the respective, alternate conductive surfaces 7A,7B by placing conductive contacting bars 17,18 of differing potential along the upper and lower portions of the leading face of the pleated filter assembly 16 to make electrical connection with the extending portions 15A,15B of the conductive surfaces 7A,7B. This provides considerable convenience in installing a pleated filter cartridge 16 in an air flow 9. The cartridge 16 need merely be slid into position against the contacting bars 17,18 to deliver polarizing potential to alternate conducting surfaces 7A,7B.

Figure 10:
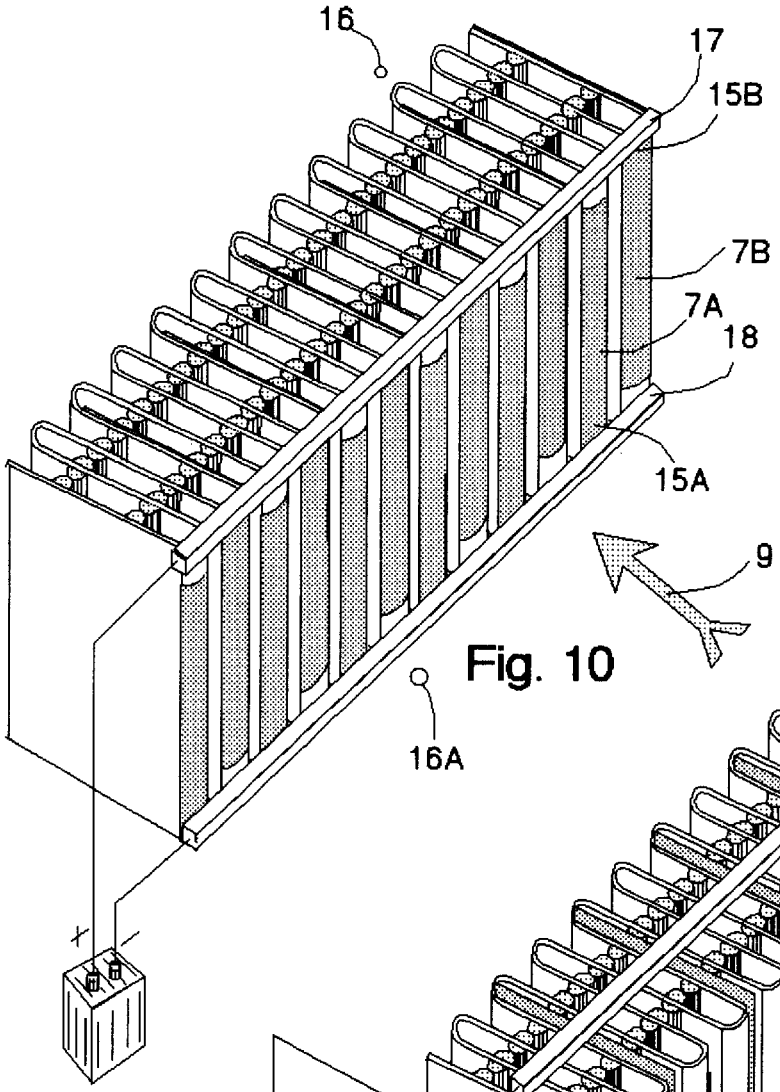
FIG. 10 depicts a pair of continuous, non-interrupted electrical contacting bars applied along the leading face of the filter media of FIG. 3A.

In FIG. 10 the contacting bars 17,18 are shown as being placed along the upstream face of the filter cartridge 16 with respect to the air flow 9. This positioning can be revised so that the contacting bars 17,18 are on the downstream side of the cartridge 16, contacting protruding, exposed conducting surface portions 15A,15B on a cartridge 16 that has been rotated 180 degrees from the orientation of FIG. 10.

Figure 3B:
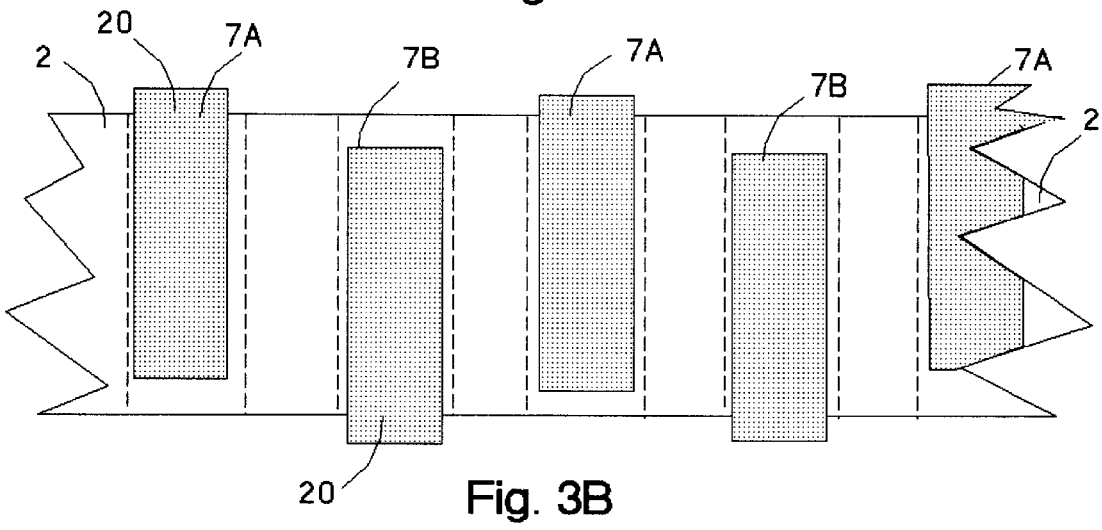
FIG. 3B is a variant on FIG. 3 that allows electrical contact to be made on the top and bottom faces of the filer media.

In FIG. 10 the contacting bars 17,18 are depicted as extending across the air-receiving face 19 of the cartridge 16. In FIG. 3B, a placement pattern is shown for the conductive surfaces on a modified filter media substrate that allows electrical contact to be made with the conductive surfaces 7A,7B along the top and bottom sides of the cartridge 16A, outside the path of airflow 9 through the filter 16A.

In FIG. 3B the conductive surface portions 7A,7B extend alternately into tabs 20 which extend beyond the normal edge of the trapping media panel, at opposite sides of the media 2. When this format of media 2 is assembled into a cartridge 16A as in FIG. 9, the tabs 20 of alternate conductive surfaces 7A,7B extend respectively above the top face and below the bottom face of the cartridge 16A. Conveniently, they may be bent or inclined to overlie each other. As the extending tabs 20 alternate with consecutive conducting surfaces 7A,7B, all the tabs 20 along the top face of the cartridge 16A can be contacted by a single contacting bar 21 of a first electrical potential; and all of the tabs 20 along the bottom face can be contacted by a contacting bar 22 of a second, polarizing, electrical potential. Such a contacting arrangement is shown in FIG. 11.

Figure 11:
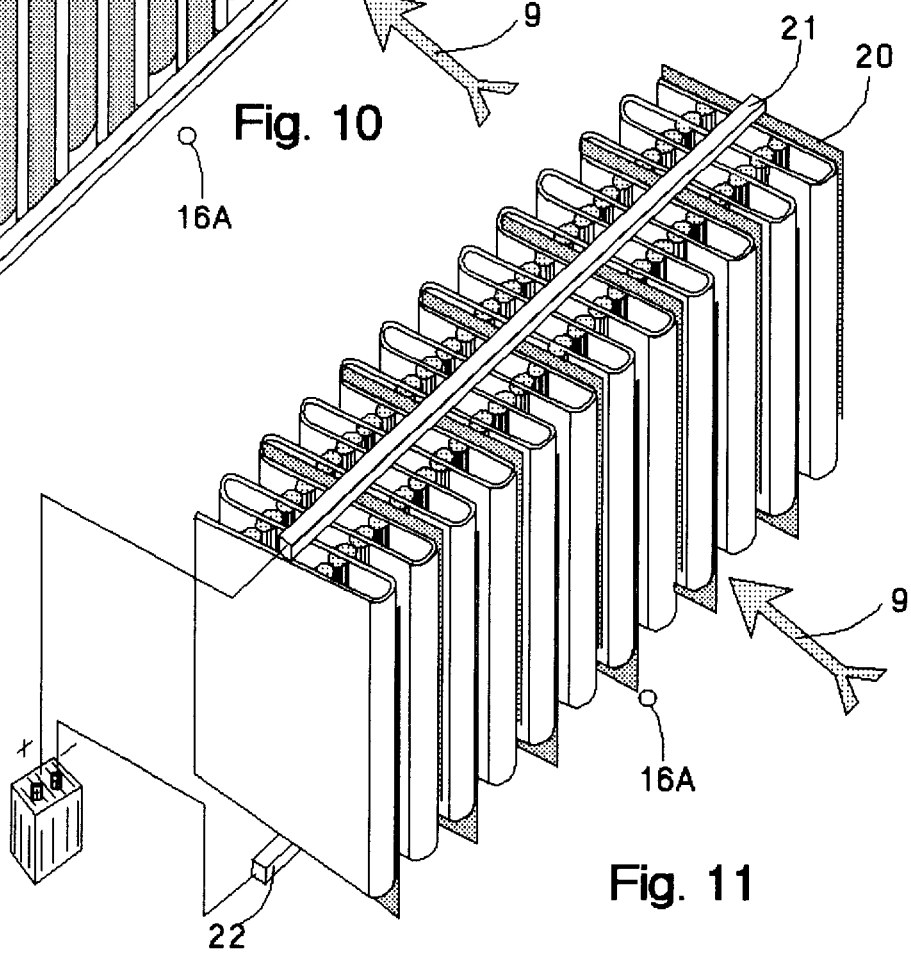
FIG. 11 is a depiction of continuous electrical contacting bars applied over the top and bottom faces of the filter media of FIG. 3B.

An advantage of the arrangement of FIG. 11 is that charged contacting bars 21,22 need not be present in the path of the air flow 9. As well, due to the enlarged contacting surface accessible on the protruding tabs 20, less voltage drop can be achieved in delivering potential to the adjacent areas of the conducting surfaces 7A,7B. This is particularly convenient in the cases where the cartridges 16A have deep pleats extending for an extended length along the direction of the air flow 9.

A concern in preparing pleated trapping media 2 with alternately charged conductive surfaces 7 is the leakage of current that may arise between adjacent panels 19. A significant source of current leakage may arise from moisture accumulating in the trapping media 2. This may particularly occur when the trapping medium 2 is made of fine paper of the type used in other known HEPA filters.

Figure 3C:
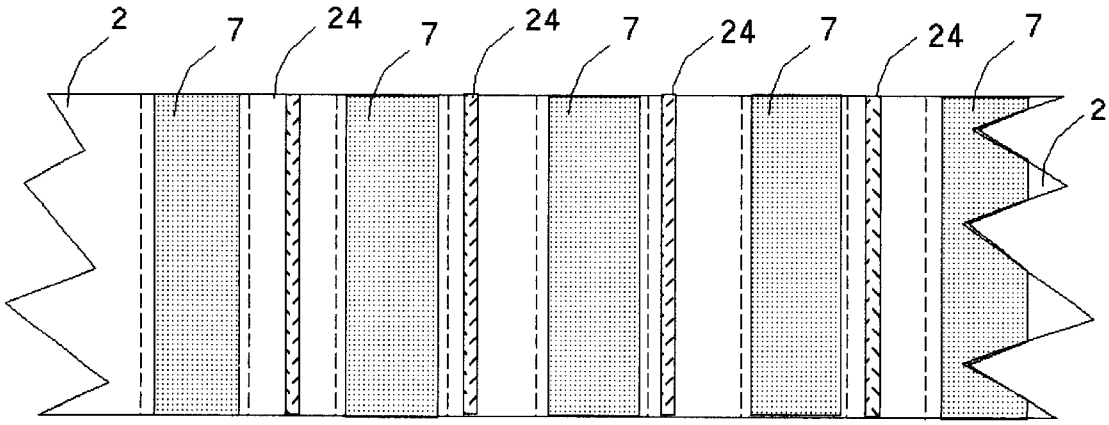
FIG. 3C is a variant of FIG. 3 that includes an isolating strip to minimize electrical leakage.

To minimize current leakage when moisture is present in the air flow 9 to be filtered, the media 2 to be employed in the pleated filter cartridge may be treated in the manner shown in FIG. 3C. In this Figure, similar to FIG. 3, the trapping media is modified by a series of narrow strips 24 extending transversely across the width of the developed trapping media surface. These strips 24 are impregnated with a sealant, such as wax. The purpose of this sealant is to exclude the infiltration of moisture into the matrix of the trapping media 2. By providing impregnated strips 24 that extend entirely across the width of the developed media 2, electrical isolation between adjacent conductive surfaces 7 can be maximized.

Test were conducted with an air flow volume of around 1000 cfm (cubic feet per minute) with a pleated filter of about 6 inches in depth and an area of 20×24 inches, installed as in FIG. 1. The results of these tests are useful for the comparison of relative performances, and are not to be taken as accurate in absolute terms. Particle counts were taken in household air with an INNOVATION 5000 particle count meter by Climet Corporation of California. Efficiencies were alternately calculated in accordance with the following formulae, repeatedly applied to sets of measurement data:

$$Eff = \frac{\overline{us} - ds_1}{\overline{us}} \times 100 \quad \text{where } \overline{us} = \frac{\overline{us_1} + us_2}{2}$$

$$Eff = \frac{us_2 - \overline{ds}}{us_2} \times 100 \quad \text{where } \overline{ds} = \frac{ds_1 + ds_2}{2}$$

On this basis, test results are shown in Tables 1 to 5 which now follow:

TABLE 1

| | Test with no ionizing elements and no voltage on the plates (Particle Counts = PC) | | | | | | | |
|---|---|---|---|---|---|---|---|---|
| PC at | .3 mic | % Eff | .5 mic | % Eff | 1 mic | % Eff | 5 mic | % Eff |
| $us_1$ | 25096 | 15.00(a) | 5462 | 14.05 | 586 | 40.08 | 20 | 20.00 |
| $ds_1$ | 21519 | 15.45(b) | 4580 | 10.21 | 376 | 37.67 | 16 | 40.00 |
| $us_2$ | 25535 | 15.47(a) | 5195 | 15.32 | 669 | 31.13 | 20 | 61.90 |
| $ds_2$ | 21660 | | 4749 | | 458 | | 8 | |
| us | 25713 | | 6022 | | 661 | | 22 | |
| Average Eff. | | 15.31 | | 13.19 | | 36.29 | | 40.63 |

us = upstream
ds = downstream

TABLE 2

| | Test with negative ionizing elements and no voltage on the plates | | | | | | | |
|---|---|---|---|---|---|---|---|---|
| PC at | .3 mic | % Eff | .5 mic | % Eff | 1 mic | % Eff | 5 mic | % Eff |
| us | 26078 | 26.39 | 9450 | 65.75 | 1307 | 68.28 | 42 | 86.52 |
| ds | 19827 | 26.15 | 3422 | 65.95 | 448 | 70.19 | 6 | 81.91 |
| us | 27789 | 23.37 | 10530 | 67.74 | 1518 | 72.84 | 47 | 81.51 |
| ds | 21215 | 22.02 | 3748 | 68.60 | 457 | 73.58 | 11 | 77.78 |
| us | 27583 | 26.05 | 12707 | 69.95 | 1847 | 75.12 | 72 | 73.08 |
| ds | 21804 | | 4232 | | 519 | | 21 | |
| us | 31390 | | 15464 | | 2325 | | 84 | |
| Average Eff. | | 24.80 | | 67.60 | | | | 80.16 |

TABLE 3

| | Test on pleated filter without ionizing elements and positive 8KV on alternate plates with other plates grounded | | | | | | | |
|---|---|---|---|---|---|---|---|---|
| PC at | .3 mic | % Eff | .5 mic | % Eff | 1 mic | % Eff | 5 mic | % Eff |
| ds | 1963 | 51.20 | 285 | 52.91 | 128 | 75.57 | 128 | 75.57 |
| us | 4404 | 49.21 | 669 | 53.38 | 524 | 78.40 | 524 | 78.40 |
| ds | 2335 | 47.89 | 345 | 51.36 | 128 | 74.43 | 128 | 74.43 |
| us | 4791 | 49.87 | 811 | 52.67 | 661 | 71.96 | 661 | 71.96 |
| ds | 2658 | | 444 | | 210 | | 210 | |
| us | 5813 | | 1065 | | 837 | | 837 | |
| Average Eff. | | 49.54 | | 52.58 | | 75.09 | | 75.09 |

TABLE 4

| | Test with negative ionizing elements and negative 8KV on plates | | | | | | | |
|---|---|---|---|---|---|---|---|---|
| PC at | .3 mic | % Eff | .5 mic | % Eff | 1 mic | % Eff | 5 mic | % Eff |
| ds | 771 | 68.30 | 114 | 67.13 | 72 | 61.75 | 6 | 86.11 |
| us | 2711 | 68.59 | 432 | 67.40 | 332 | 59.96 | 54 | 89.60 |
| ds | 938 | | 170 | | 182 | | 9 | |
| us | 3325 | | 611 | | 577 | | 119 | |
| Average Eff. | | 68.44 | | 67.27 | | 60.85 | | 87.85 |

TABLE 5

| | Second test with two negative ionizing elements and negative 8KV on plates | | | | | | | |
|---|---|---|---|---|---|---|---|---|
| PC at | .3 mic | % Eff | .5 mic | % Eff | 1 mic | % Eff | 5 mic | % Eff |
| us | 14236 | 66.61 | 1284 | 69.76 | 106 | 74.55 | 18 | 100.0 |
| ds | 4894 | 69.75 | 417 | 68.42 | 28 | 74.12 | 0 | 96.43 |

TABLE 5-continued

| | Second test with two negative ionizing elements and negative 8KV on plates | | | | | | | |
|---|---|---|---|---|---|---|---|---|
| PC at | .3 mic | % Eff | .5 mic | % Eff | 1 mic | % Eff | 5 mic | % Eff |
| us | 16941 | 70.44 | 1474 | 67.34 | 114 | 76.15 | 14 | 93.55 |
| ds | 5355 | 68.65 | 514 | 66.04 | 31 | 76.71 | 1 | 88.24 |
| us | 19288 | 67.34 | 1674 | 65.78 | 146 | 76.95 | 17 | 82.35 |
| ds | 6739 | 67.10 | 623 | 66.57 | 37 | 74.00 | 3 | 88.35 |
| us | 21975 | 67.48 | 1967 | 67.20 | 175 | 73.46 | 17 | 88.24 |
| ds | 7720 | | 692 | | 54 | | | |
| us | 25509 | | 2253 | | 232 | | | |
| Average Eff. | | 68.48 | | 67.30 | | 75.14 | | 90.16 |

The progressive improvements in measured efficiency are apparent, with maximum efficiency arising with the combination of upstream ionization and charged, polarized plates.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

We claim:

1. An air filter cartridge for removing dust from an airflow comprising:

(a) polarizable, non-conductive, air-permeable, folded trapping medium with two sides that is folded along edges in an accordion shaped form to provide panel surfaces delimited by said fold edges;

(b) a plurality of air permeable polarizing electrodes formed between said folded edges of said medium, on non-contiguous panel surfaces; and (c) electrical contact means associated with said electrodes for connecting the polarizing electrodes to a source of electrical charge to provide an alternate polarizing charge potential to respective alternate polarizing electrodes and thereby provide a polarizing potential therebetween whereby, upon connection to a source of electrical potential, said polarizing electrodes will cause said trapping medium to become polarized transversely across said panels to trap dust particles from air flow passing transversely therethrough.

2. An air filter cartridge as in claim 1 wherein said polarizing electrodes are formed on one side only of said trapping medium.

3. An air filer cartridge as in claim 2 wherein said panel surfaces are aligned in substantially parallel orientation to each other.

4. An air filter cartridge as in claim 1 wherein said polarizing plate electrodes are provided by sections of said medium which are rendered conducting.

5. An air filter cartridge as in claim 4 wherein said panel surfaces are aligned in substantially parallel orientation to each other.

6. An air filter cartridge as in claim 1 wherein said polarizing plate electrodes are provided by sections of said medium upon which a conductive layer has been deposited.

7. An electronic air cleaner as in claim 1 wherein said panel surfaces are aligned in substantially parallel orientation to each other and substantially in alignment with the direction of the arriving airflow.

8. An electronic air cleaner for removing dust from an arriving air flow comprising:

(a) polarizable, non-conductive, air-permeable, foldable trapping medium with two sides that is folded along fold edges in an accordion shaped form to provide panel surfaces delimited in part by said fold edges, said folded medium being positioned to present said fold edges to an arriving air flow for collecting dust particles therefrom;

(b) a plurality of air-permeable polarizing electrodes formed between said folded edges of said medium on non-contiguous panel surfaces, said electrodes having electrode surfaces and having electrode edges that are aligned to permit air flow to arrive, generally edge-on and thereafter to pass transversely through said electrode and panel surfaces;

(c) a source of electrical potential to supply alternating, polarizing, charge potential to consecutive polarizing electrodes and provide a polarizing potential therebetween; and (d) a pair of electrical connectors for alternately contacting said polarizing electrodes and delivering said alternating charge potential thereto wherein the trapping medium associated with said panel surfaces is positioned between said polarizing electrodes to become polarized transversely across said panel surfaces to enhance the trapping of dust particles from air flow passing transversely therethrough.

9. An electronic air cleaner as in claim 8 wherein said polarizable electrodes are formed on one side only of the foldable trapping medium.

10. An electronic air cleaner as in claim 9 wherein said panel surfaces are aligned in substantially parallel orientation to each other, lying substantially in alignment with the direction of the arriving airflow.

11. An electronic air cleaner as in claim 9 wherein the trapping medium comprises a fibrous material.

12. An electronic air cleaner as in claim 9 comprising ionizing means to introduce ions into air flow entering the trapping medium and increase the air cleaner's efficiency.

13. An electronic air cleaner as in claim 8 wherein said polarizing electrodes are provided by sections of said medium which are rendered conducting.

14. An electronic air cleaner as in claim 13 wherein said panel surfaces are aligned in substantially parallel orientation to each other, lying substantially in alignment with the direction of the arriving airflow.

15. An electronic air cleaner as in claim 13 wherein the trapping medium comprises a fibrous material.

16. An electronic air cleaner as in claim 13 comprising ionizing means to introduce ions into air flow entering the trapping medium and increase the air cleaner's efficiency.

17. An electronic air cleaner as in claim 8 wherein said polarizing electrodes are provided by sections of said medium upon which a conductive layer has been deposited.

18. An electronic air cleaner as in claim 8 wherein said panel surfaces are aligned in substantially parallel orientation to each other, lying substantially in alignment with the direction of the arriving airflow.

19. An electronic air cleaner as in claim 8 wherein the trapping medium comprises a fibrous material.

20. An electronic air cleaner as in claim 8 comprising ionizing means to introduce ions into air flow entering the trapping medium and increase the air cleaner's efficiency.

* * * * *